US010220644B2

(12) United States Patent
Kasahara

(10) Patent No.: US 10,220,644 B2
(45) Date of Patent: Mar. 5, 2019

(54) PRINTING DEVICE AND PRINTING METHOD

(71) Applicant: MIMAKI ENGINEERING CO., LTD., Nagano (JP)

(72) Inventor: Junki Kasahara, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 15/671,147

(22) Filed: Aug. 8, 2017

(65) Prior Publication Data

US 2018/0043720 A1 Feb. 15, 2018

(30) Foreign Application Priority Data

Aug. 10, 2016 (JP) ..... 2016-157253

(51) Int. Cl.

| | |
|---|---|
| ***B41J 11/00*** | (2006.01) |
| ***B41M 7/00*** | (2006.01) |
| ***B41J 2/21*** | (2006.01) |
| *B41J 2/135* | (2006.01) |
| *B41J 29/38* | (2006.01) |

(52) U.S. Cl.

CPC ..... *B41M 7/0081* (2013.01); *B41J 2/2114* (2013.01); *B41J 11/002* (2013.01); *B41J 2/135* (2013.01); *B41J 29/38* (2013.01)

(58) Field of Classification Search

CPC .... B41M 7/0081; B41J 2/2114; B41J 11/002; B41J 2/135; B41J 29/38

See application file for complete search history.

(56) References Cited

U.S. PATENT DOCUMENTS

| | | | | |
|---|---|---|---|---|
| 2011/0116152 | A1* | 5/2011 | Guigan | B29D 11/00365 359/242 |
| 2011/0157272 | A1 | 6/2011 | Ikehata et al. | |
| 2012/0156436 | A1* | 6/2012 | Kim | C09K 11/565 428/172 |
| 2012/0287190 | A1* | 11/2012 | Shimada | B41J 2/2114 347/12 |
| 2013/0057608 | A1* | 3/2013 | Yamamoto | G02B 3/005 347/9 |
| 2015/0224795 | A1 | 8/2015 | Ogawa | |

FOREIGN PATENT DOCUMENTS

| | | |
|---|---|---|
| JP | 2012-187927 | 10/2012 |
| JP | 2015193089 | 11/2015 |

OTHER PUBLICATIONS

"Search Report of European Counterpart Application," dated Jan. 5, 2018, p. 1-p. 10, in which the listed references were cited.

* cited by examiner

*Primary Examiner* — Yaovi M Ameh
(74) *Attorney, Agent, or Firm* — JCIPRNET

(57) ABSTRACT

An ink jet printer serving as a printing device repeats a selective discharge of a first ultraviolet curing type ink to a plurality of landing positions by an ink jet head and an irradiation of the first ultraviolet curing type ink with an ultraviolet ray by an ultraviolet ray irradiating device while reciprocating a carriage to form projection main bodies of the first ultraviolet curing type ink at the plurality of landing positions, and causes the ink jet head to selectively discharge a second ultraviolet curing type ink so as to land on the plurality of projection main bodies and the ultraviolet ray irradiating device to irradiate the second ultraviolet curing type ink with the ultraviolet ray to cure the second ultraviolet curing type ink to a gloss form.

13 Claims, 7 Drawing Sheets

PRINTING DEVICE AND PRINTING METHOD

CROSS REFERENCE TO RELATED APPLICATIONS

This application claims the priority benefit of Japanese Patent Application No. 2016-157253, filed on Aug. 10, 2016. The entirety of the above-mentioned patent application is hereby incorporated by reference herein and made a part of this specification.

TECHNICAL FIELD

The present disclosure relates to a printing device and a printing method for discharging ink to a medium through an ink jet method.

DESCRIPTION OF THE BACKGROUND ART

A printing device that discharges an ultraviolet curing type ink through an ink jet method to form a plurality of microscopic projections on a media, and cures and fixes the ink with an ultraviolet ray is known (e.g., Japanese Unexamined Patent Publication No. 2012-187927).

When the plurality of microscopic projections are formed with a clear ink on the media, on which an image is printed with a color ink, such microscopic projections can act as a microlens thus providing change in a visual effect with respect to the image, and furthermore, such microscopic projections can also provide change in texture or tactual sense of a printed matter (emboss printing).

Japanese Unexamined Patent Publication No. 2012-187927 discloses a method for adjusting a size or a curvature of the microlens by adjusting a number of liquid droplets and a discharging amount of the ink. FIG. 7 is a view showing a microlens formed with the number of liquid droplets and the discharging amount of the ink adjusted. As shown in FIG. 7, one microlens is formed by layering a plurality of layers of liquid droplets.

SUMMARY

However, in the printing device described in Japanese Unexamined Patent Publication No. 2012-187927, when configuring one microlens with a plurality of liquid droplets, as shown in FIG. 7, a microscopic bump forms on the surface thereof and hence a smooth lens curved surface cannot be obtained. When the microscopic bump is formed on the surface of the lens, diffuse reflection of the light occurs, and a sense of unity as one lens cannot be obtained. Similarly when the emboss printing is carried out using such printing device, the surface of each projection does not become smooth, and a desired texture or tactual sense may not be obtained.

In light of the foregoing, the present disclosure provides a printing device and a printing method capable of forming a projection having a smooth surface using an ultraviolet curing type ink on a medium.

A printing device according to one aspect of the present disclosure includes an ink discharging unit that discharges an ultraviolet curing type ink as a liquid droplet; an ultraviolet ray irradiating unit that irradiates a medium, to which the ultraviolet curing type ink is discharged, with an ultraviolet ray; a scanning unit that relatively reciprocates the ink discharging unit, the ultraviolet ray irradiating unit, and the medium in a main scanning direction; and a controller that controls the ink discharging unit, the ultraviolet ray irradiating unit, and the scanning unit. The controller carries out a selective discharge of a first ultraviolet curing type ink to a plurality of landing positions by the ink discharging unit and an irradiation of the first ultraviolet ray curing type ink with the ultraviolet ray by the ultraviolet ray irradiating unit while reciprocating the scanning unit to form a plurality of projection main bodies of the first ultraviolet ray curing type ink at the plurality of landing positions, causes the ink discharging unit to selectively discharge a second ultraviolet curing type ink so as to land on the plurality of projection main bodies, and causes the ultraviolet ray irradiating unit to irradiate the second ultraviolet curing type ink with the ultraviolet ray to cure the second ultraviolet ray curing type ink to a gloss form.

According to such configuration, the projection main bodies are formed with the first ultraviolet curing type ink, and the second ultraviolet curing type ink of gloss form is coated thereon, so that the projection having a smooth surface can be formed. Furthermore, since the second ultraviolet curing type ink is selectively discharged so as to land on the projection main bodies formed by the first ultraviolet curing type ink, each projection can have a stereoscopic effect compared to when the second ultraviolet curing type ink is applied over the entire surface.

In the printing device described above, the controller may cause the ink discharging unit to selectively discharge the first ultraviolet curing type ink to the plurality of landing positions and the ultraviolet ray irradiating unit to irradiate the first ultraviolet curing type ink with the ultraviolet ray in one forward movement or backward movement by the scanning unit, and repeat the discharge of the first ultraviolet curing type ink and the irradiation of the first ultraviolet curing type ink with the ultraviolet ray to form a plurality of matted projection main bodies of the first ultraviolet curing type ink at the plurality of landing positions.

According to such configuration, the projection main bodies by the first ultraviolet curing type ink are formed by a plurality of layers of first ultraviolet curing type ink by repeating the discharge and the curing for every layer, and thus the size and the interval thereof can be arbitrarily set.

In the printing device described above, the controller may cause the ink discharging unit to selectively discharge a second ultraviolet curing type ink so as to land on the plurality of projection main bodies, and the ultraviolet ray irradiating unit to irradiate the second ultraviolet curing type ink with the ultraviolet ray to perform a temporary curing of the second ultraviolet curing type ink, and thereafter cause the ultraviolet ray irradiating unit to irradiate the second ultraviolet curing type ink with the ultraviolet ray to perform a full curing of the second ultraviolet curing type ink.

According to such configuration, the second ultraviolet curing type ink selectively discharged so as to land on the plurality of projection main bodies can be cured to the gloss form by the full curing after the surface is smoothened while being suppressed from flowing and spreading to the periphery of the original landing position by the temporary curing.

In the printing device described above, the controller may carry out a control so that the second ultraviolet curing type ink selectively discharged to land on the plurality of projection main bodies is cured while being spaced apart from each other. According to such configuration, a more three-dimensional projection having a smooth surface can be formed.

In the printing device described above, the ink discharging unit may discharge the first ultraviolet curing type ink and the second ultraviolet curing type ink onto a back surface of a surface formed with an image in a transparent medium, and the first ultraviolet curing type ink and the second ultraviolet curing type ink may be clear ink. According to such configuration, the plurality of projections can function as the microlens to provide change in the visual effect of the image.

In the printing device described above, the ink discharging unit may discharge the first ultraviolet curing type ink and the second ultraviolet curing type ink onto a surface formed with an image in the medium, and the first ultraviolet curing type ink and the second ultraviolet curing type ink may be clear ink. According to such configuration, the projection can be formed on the image so as not to impair the visibility of the image formed on the medium.

In the printing device described above, the ink discharging unit may discharge the first ultraviolet curing type ink and the second ultraviolet curing type ink onto a surface formed with an image in the medium, and the second ultraviolet curing type ink may be a color ink corresponding to the image. According to such configuration, the surface of the projection can be formed and one part of the image can be formed with the second ultraviolet curing type ink.

In the printing device described above, the ink discharging unit may discharge the first ultraviolet curing type ink and the second ultraviolet curing type ink onto a surface formed with an image in the medium, and the first ultraviolet curing type ink may be a color ink corresponding to the image and the second ultraviolet curing type ink may be a clear ink. According to such configuration, the projection main body can be formed and one part of the image can be formed with the first ultraviolet curing type ink. Furthermore, since the second ultraviolet curing type ink on the outer side of the projection main body is a clear ink, the visibility of the image formed in such manner is not impaired.

In the printing device described above, the scanning unit may relatively move the ink discharging unit, the ultraviolet ray irradiating unit, and the medium in a sub-scanning direction orthogonal to the main scanning direction, the controller may form the projection main bodies and discharge the second ultraviolet curing type ink thereon and cures the ink to a gloss form by merely relatively moving the ink discharging unit, the ultraviolet ray irradiating unit, and the medium once in the sub-scanning direction. According to such configuration, the projection having a smooth surface can be formed at high speed.

In the printing device described above, each projection main body may be configured by a plurality of liquid droplets of the first ultraviolet curing type ink. According to such configuration, the projection of an arbitrary size can be formed.

In the printing device described above, each projection main body may be configured by a plurality of layers of the first ultraviolet curing type ink. According to such configuration, the projection of an arbitrary height can be formed.

In the printing device described above, the height of each projection main body may be 70 μm to 400 μm. According to such configuration, the projection that functions as the microlens or functions as a projection that provides texture or tactual sense can be formed.

A printing method according to one aspect of the present disclosure includes the steps of carrying out selective discharge of a first ultraviolet curing type ink to a plurality of landing positions by an ink discharging unit and an irradiation of the first ultraviolet ray curing type ink with an ultraviolet ray by an ultraviolet ray irradiating unit while relatively reciprocating the ink discharging unit that discharges an ultraviolet curing type ink as a liquid droplet, the ultraviolet ray irradiating unit that irradiates a medium, to which the ultraviolet curing type ink is discharged, with an ultraviolet ray, and the medium to form a plurality of projection main bodies of the first ultraviolet curing type ink at the plurality of landing positions; selectively discharging a second ultraviolet curing type ink from the ink discharging unit so as to land on the plurality of projection main bodies, and irradiating the second ultraviolet curing type ink with the ultraviolet ray from the ultraviolet ray irradiating unit to cure the second ultraviolet curing type ink to a gloss form.

According to such configuration, the projection main bodies are formed with the first ultraviolet curing type ink, and the second ultraviolet curing type ink of gloss form is coated thereon, so that the projection having a smooth surface can be formed. Furthermore, since the second ultraviolet curing type ink is selectively discharged so as to land on the projection main bodies formed by the first ultraviolet curing type ink, each projection can have a stereoscopic effect compared to when the second ultraviolet curing type ink is applied over the entire surface.

The present disclosure can form a projection main body with a smooth surface as the projection is formed with the first ultraviolet curing type ink, and the second ultraviolet curing type ink of gloss form is coated thereon. Furthermore, since the second ultraviolet curing type ink is selectively discharged so as to land on the projection main body formed by the first ultraviolet curing type ink, each projection can have a stereoscopic effect compared to when the second ultraviolet curing type ink is applied over the entire surface.

DETAILED DESCRIPTION OF EMBODIMENTS

Hereinafter, a printing device and a printing method of an embodiment of the present disclosure will be described with reference to the drawings. An ink jet printer and an ink jet print method for forming an image and a projection on a medium by discharging an ultraviolet curing type ink toward a surface of a medium (recording medium), and irradiating the ultraviolet curing type ink landed on the medium with an ultraviolet ray to cure the ink will be described below for the printing device and the printing method of the present embodiment.

Figure 1:
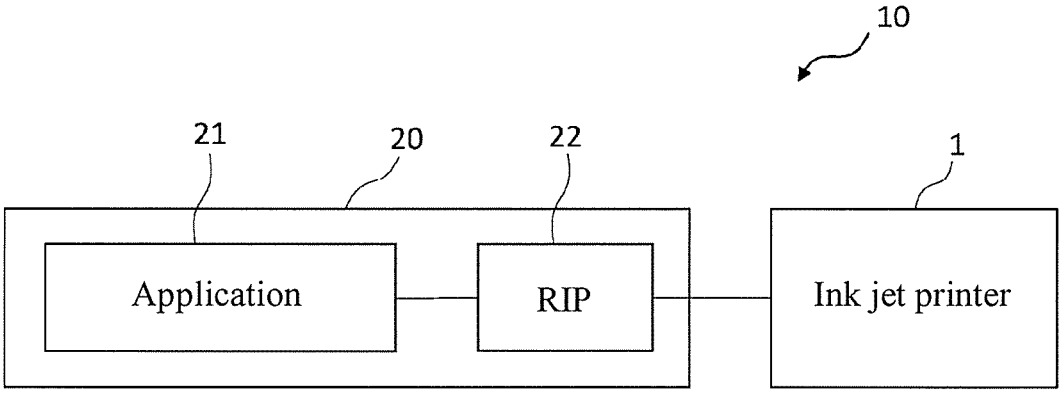
FIG. 1 is a view showing a configuration of an ink jet printer system including an ink jet printer according to an embodiment of the present disclosure.

FIG. 1 is a view showing a configuration of an ink jet printer system including an ink jet printer according to an embodiment of the present disclosure. As shown in FIG. 1, an ink jet printer system 10 is configured by an ink jet printer 1 according to the present embodiment, and an external device 20 such as a personal computer. The ink jet printer 1 and the external device 20 are communicably connected. The ink jet printer 1 and the external device 20 may perform communication wirelessly.

The external device 20 incorporates an application 21 that creates image data of an image to be formed with the ink jet printer 1, and an RIP (Raster Image Processor) 22 that generates print data for printing with the ink jet printer 1 based on the image data. The RIP 22 may be incorporated in the ink jet printer 1.

Figure 2:
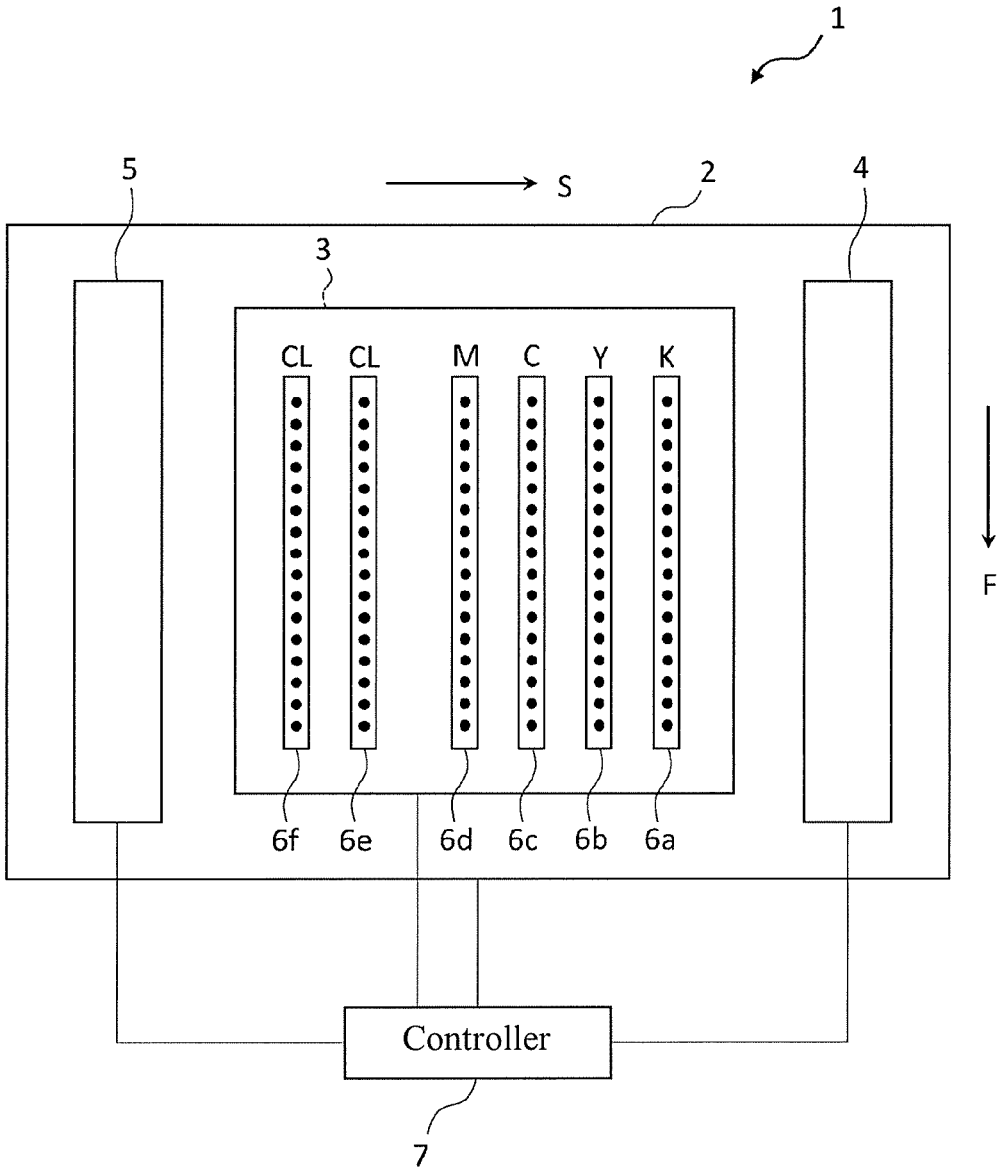
FIG. 2 is a schematic view showing the ink jet printer according to the embodiment of the present disclosure.

FIG. 2 is a schematic view showing the ink jet printer according to the embodiment of the present disclosure. As shown in FIG. 2, the ink jet printer 1 according to the present embodiment includes a carriage 2 that can reciprocate in a scanning direction (main scanning direction) S. A head unit 3, an ultraviolet ray irradiating device 4, and an ultraviolet ray irradiating device 5 are mounted on the carriage 2.

The ultraviolet ray irradiating device 4 is disposed on a front side in the scanning direction S of the head unit 3, and the ultraviolet ray irradiating device 5 is disposed on a back side in the scanning direction S of the head unit 3. A plurality of ink jet heads 6 that discharge an ultraviolet curing type ink as a liquid droplet are mounted on the head unit 3. The ink jet printer 1 further includes a controller 7 that controls the carriage 2, the ink jet head 6, the ultraviolet ray irradiating device 4, and the ultraviolet ray irradiating device 5.

The ink jet printer 1 transports a media by a path width at a time in a feed direction (sub-scanning direction) F orthogonal to the scanning direction S and moves the carriage 2 in the scanning direction S to carry out scanning of discharging the ultraviolet curing type ink from the ink jet head 6 and irradiating the ultraviolet ray from the ultraviolet ray irradiating device 4 and the ultraviolet ray irradiating device 5, thus forming an image on a medium. The ink jet head 6 can discharge an ink droplet on the medium at a resolution of, for example, 600 dpi×900 dpi.

The carriage 2 is movably held by a guide rail (not shown) extending in the scanning direction S at an upper side of a platen (not shown) where the medium is transported. A drive mechanism (not shown) such as a drive motor is mounted on the carriage 2, thus allowing the carriage 2 to reciprocate in the scanning direction S along the guide rail by the drive of the drive mechanism.

The drive mechanism does not necessarily need to be mounted on the carriage 2, and may be mounted on the ink jet printer 1 as a member separate from the carriage 2. In this case, the drive control of the carriage 2 by the controller 7, to be described later, becomes a drive control of the drive mechanism mounted on the ink jet printer 1 as a member separate from the carriage 2. The ink jet head 6 mounted on the head unit 3 corresponds to an ink discharging unit of the present disclosure, and a configuration including the carriage 2 mounted with the head unit 3, the guide rail for reciprocating the carriage 2, and the drive mechanism corresponds to a scanning unit of the present disclosure.

The head unit 3 is an ink discharging device incorporating a plurality of ink jet heads 6 (6*a* to 6*f*) that discharge the ultraviolet curing type ink. Since the head unit 3 is mounted on the carriage 2, the ultraviolet curing type ink can be discharged from each ink jet head 6*a* to 6*f* at the time of movement in the scanning direction S and an opposite direction thereof involved in the movement of the carriage 2. The ink jet heads 6*a* to 6*f* are arranged side by side along the scanning direction S, and arrayed in the order of the ink jet heads 6*a*, 6*b*, 6*c*, 6*d*, 6*e*, 6*f* from the front side toward the back side in the scanning direction S.

A plurality of nozzles that discharge the ultraviolet curing type ink as a liquid droplet are formed on each ink jet heads 6*a* to 6*f*. Such pluralities of nozzles are arranged in a line in the feed direction F to form a nozzle row. A colored ultraviolet curing type ink (hereinafter also referred to as "color ink") is discharged from the ink jet heads 6*a* to 6*d* arranged on the front side in the scanning direction S, and an ultraviolet curing type ink having translucency (hereinafter also referred to as "clear ink") is discharged from the ink jet heads 6*e*, 6*f* arranged on the back side in the scanning direction S.

Specifically, a black (K) color ink is discharged from the nozzle row of the ink jet head 6*a*, a yellow (Y) color ink is discharged from the nozzle row of the ink jet head 6*b*, a cyan (C) color ink is discharged from the nozzle row of the ink jet head 6*c*, and a magenta (M) color ink is discharged from the nozzle row of the ink jet head 6*d*. Furthermore, a clear ink (CL) is discharged from each nozzle row of the ink jet heads 6*e*, 6*f*.

The ultraviolet curing type ink of the present embodiment is an ink that is cured when irradiated with the ultraviolet ray, and contains a resin such as monomer, oligomer, or the like that polymerizes when irradiated with the ultraviolet ray as a binder. Such resin may be epoxy acrylate, urethane acrylate, polyester acrylate, and the like. Furthermore, the ultraviolet curing type ink may contain a pigment and a dye such as a photopolymerization initiator, a sensitizer and may contain, for example, a bearing agent, an antifungal agent, and the like for other components.

The ultraviolet ray irradiating device 4 irradiates the ultraviolet curing type ink applied on the medium with the ultraviolet ray to cure the ultraviolet curing type ink. The ultraviolet ray irradiating device 4 includes a plurality of ultraviolet ray emitting diodes (hereinafter referred to as "Ultra Violet Light Emitting Diode (UVLED)") as a main component, where the ultraviolet ray is emitted when the UVLED is turned ON, and the emission of the ultraviolet ray is stopped when the UVLED is turned OFF.

Each UVLED of the ultraviolet ray irradiating device 4 is directed toward the platen (not shown) where the medium is transported, where the medium transported on the platen is irradiated with the ultraviolet ray when the UVLED is turned ON, and the irradiation of the medium with the ultraviolet ray is stopped when the UVLED is turned OFF. Each UVLED configuring the ultraviolet ray irradiating device 4 can individually adjust the intensity (illuminance) of the ultraviolet ray to emit. Since the ultraviolet ray irradiating device 4 is mounted on the carriage 2, the ultraviolet ray can be emitted at the time of reciprocate movement in the scanning direction S involved in the movement of the carriage 2.

The ultraviolet ray irradiating device 5 irradiates the ultraviolet curing type ink applied on the medium with the ultraviolet ray to cure the ultraviolet curing type ink, similar to the ultraviolet ray irradiating device 4. The ultraviolet ray irradiating device 5 includes the UVLED as a main component, where the ultraviolet ray is emitted when the UVLED is turned ON, and the emission of the ultraviolet ray is stopped when the UVLED is turned OFF.

The UVLED of the ultraviolet ray irradiating device 5 is directed toward the platen (not shown) where the medium is transported, where the medium transported on the platen is irradiated with the ultraviolet ray when the UVLED is turned ON, and the irradiation of the medium with the ultraviolet ray is stopped when the UVLED is turned OFF.

Each UVLED configuring the ultraviolet ray irradiating device 5 can individually adjust the intensity (illuminance) of the ultraviolet ray to emit. Since the ultraviolet ray irradiating device 5 is mounted on the carriage 2, the ultraviolet ray can be emitted at the time of reciprocate movement in the scanning direction S involved in the movement of the carriage 2.

The controller 7 carries out the print control of the ink jet printer 1 by controlling the carriage 2, the ink jet head 6, the ultraviolet ray irradiating device 4, and the ultraviolet ray irradiating device 5. The ink jet printer 1 has a projection forming mode of forming a plurality of projections on the medium, in addition to a normal image forming mode, which modes can be selectively switched. The mode may be selected based on the print data transmitted from the RIP 22, or may be directly selected by a user with respect to the ink jet printer 1.

The controller 7 carries out the drive control of the carriage 2, the ink discharging control of the ink jet head 6, and the ultraviolet ray irradiation control of the ultraviolet ray irradiating device 4 and the ultraviolet ray irradiating device 5 according to the print data transmitted from the RIP 22. The controller 7 is, for example, configured with a computer including a CPU, a ROM, and a RAM as a main body, where the control of the controller 7, to be described later, is realized by causing the CPU and the RAM to read predetermined computer software, and operating the same under the control of the CPU. As described above, the RIP 22 may be provided in the ink jet printer 1, but in this case, the controller 7 also functions as the RIP 22.

Returning back to FIG. 1, in the image forming mode, the RIP 22 generates the print data of dotted format for printing with the ink jet printer 1 based on the image data of EPS form, TIFF format, and the like created by the application 21, and transmits the print data to the ink jet printer 1 to cause the ink jet printer to form the image.

In the projection forming mode of forming the plurality of projection shapes, the user can specify a region to form the plurality of projections, a size of a diameter, a height, and an interval of each projection using the application 21. The RIP 22 generates the print data for forming the plurality of projections having a specification specified with the application 21, and transmits the print data to the ink jet printer 1. Such print data is configured by presence/absence of discharge of the ultraviolet curing type ink, number of discharge of the ultraviolet curing type ink, discharging amount (dot size) of the ultraviolet curing type ink, and the like for every pixel of a predetermined pitch (resolution). The print data is corresponded to the ink jet heads 6*a* to 6*f*.

Figure 3:
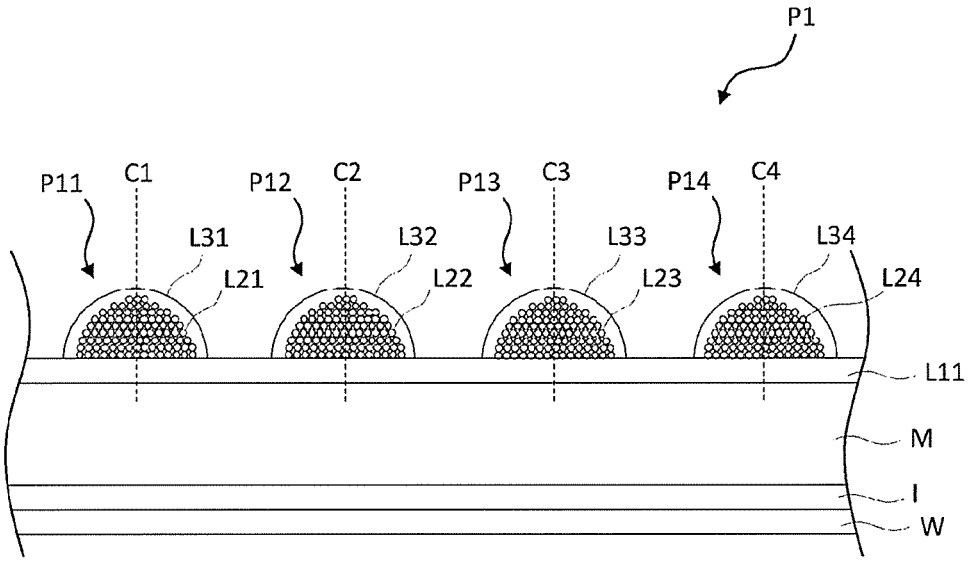
FIG. 3 is a view showing a cross-sectional view of a printed matter according to the embodiment of the present disclosure.

FIG. 3 is a view showing a cross-sectional view of a printed matter according to the present embodiment. A medium M used for a printed matter P1 is a transparent sheet or plate having translucency, and is specifically a transparent acrylic sheet or plate. As shown in FIG. 3, an image I is formed on a lower surface of the medium M using the color ink. A plurality of projections P11 to P14 that function as a microlens are formed on an upper surface of the medium M, that is, a back surface of the surface formed with the image by the clear ink. In FIG. 3, only four projections P11 to P14 are shown, but the projections are distributed two dimensionally at the specified interval and size in the specified region of the medium M. Each projection P11 to P14 have a dome shape with a circular horizontal cross-section.

The printed matter P1 is observed or viewed from the upper surface side of FIG. 3, and the image I on the lower surface is also printed in that matter. Therefore, a white layer W is formed using the color ink on the surface of the image I (lower surface of the image I in FIG. 3) as a layer for protecting the ink forming the image I. When the printed matter P1 is observed from the upper surface side of FIG. 3, a three dimensional more is generated by the lens effect of the projections P11 to P14, thus changing the way the image I is viewed depending on the viewing direction. A procedure for forming the projections P11 to P14 shown in FIG. 3 will be described below.

(Formation of Underlayer L)

The ink jet printer 1 first forms an underlayer L11 on the medium M with the clear ink. The controller 7 reciprocates the carriage 2, and causes the clear ink to be discharged from the ink jet heads 6*e*, 6*f* in both a forward path (movement in the scanning direction S) and a backward path (movement in the opposite direction to the scanning direction S) of the carriage 2.

The controller 7 turns ON the ultraviolet ray irradiating device 5 on the back side in an advancing direction than the ink jet heads 6*e*, 6*f* when discharging the clear ink from the ink jet heads 6*e*, 6*f* while forward moving the head unit 3, on which the ink jet heads 6*e*, 6*f* are mounted, so that the clear ink emitted from the ink jet heads 6*e*, 6*f* and landed on the medium M is immediately cured in the forward path, and turns ON the ultraviolet ray irradiating device 4 on the back side in the advancing direction than the ink jet heads 6*e*, 6*f* when discharging the clear ink from the ink jet heads 6*e*, 6*f* while forward moving the head unit 3, on which the ink jet heads 6*e*, 6*f* are mounted, so that the clear ink emitted from the ink jet heads 6*e*, 6*f* and landed on the medium M is immediately cured in the backward path.

Thus, the clear ink emitted from the ink jet heads 6*e*, 6*f* and landed (applied) on the medium M is immediately cured, thus forming a matted underlayer L11. The underlayer L11 is formed to an even thickness at least in the region of forming the projections P11 to P14. The underlayer L11 may be formed to a gloss form.

(Formation of Projection Main Body)

Next, projection main bodies L21 to L24 are formed on the underlayer L11. Specifically, the controller 7 forms the projection main bodies L21 to L24 of a dome shape spaced apart from each other by printing the clear ink to the matted form. The controller 7 selectively discharges the clear ink to the periphery of a plurality of projection centers C1 to C4 spaced apart from each other from the ink jet heads 6*e*, 6*f* while reciprocating the carriage 2 to form a plurality of island-shaped projection main bodies L21 to L24. When referring to selectively discharging the ink, this means discharging the ink only to an area specified by the print data rather than applying the ink over the entire surface of the medium M, and, in particular, discharging the ink only to areas corresponding to the projection main bodies L21 to L24 in the present embodiment. As shown in FIG. 3, each projection main body L21 to L24 is configured by a plurality of ink liquid droplets.

When forming the projection main bodies L21 to L24 as well, the controller 7 discharges the clear ink from the ink jet heads 6*e*, 6*f* in both the forward path and the backward path of the carriage 2, and turns ON the ultraviolet ray irradiating device 5 in the forward path and turns ON the ultraviolet ray irradiating device 4 in the backward path, similar to the case of forming the underlayer L11. Thus, the clear ink is cured immediately after landing on the medium M, and the projection main bodies L21 to L24 are formed to the matted form. The projection main bodies L21 to L24 may be formed to the gloss form.

At the time of forming the projection main bodies L21 to L24, the controller 7 carries out the discharge of the clear ink to a circular region having the projection center C1 to C4 as the center by the ink jet heads 6*e*, 6*f* and the irradiation of the ultraviolet ray by the ultraviolet ray irradiating device 4 or 5 on the back side in the advancing direction in one forward movement or backward movement of the carriage 2, and repeats such discharge and irradiation over plural times, as necessary, to form the projection main bodies L21 to L24 having the projection centers C1 to C4 as the center. In this case, the controller 7 gradually reduces the diameter of the circular region to discharge the ink toward an upper layer according to the print data to form the dome shaped projection main bodies L21 to L24. The clear ink discharged to form the projection main bodies L21 to L24 corresponds to a first ultraviolet curing type ink of the present disclosure.

(Coating)

After the matted projection main bodies L21 to L24 are formed, the controller 7 reciprocates the carriage 2 and selectively discharges the clear ink from the ink jet heads 6*e*, 6*f* to a range of covering each of the projection main bodies L21 to L24 to form coating layers L31 to L34. The controller 7 again selectively discharges the clear ink to the circular region having the projection centers C1 to C4 as the center.

Furthermore, the controller 7 turns ON the ultraviolet ray irradiating device 4 or 5 on the back side in the advancing direction simultaneously with the discharge of the clear ink from the ink jet heads 6*e*, 6*f*, where the light amount is set to an amount the viscosity can be increased to an extent the landed clear ink is completely cured and the fluidity is not lost. The clear ink is thereby performed the temporary curing, and the clear ink discharged so as to cover the projection main bodies L21 to L24 can be suppressed from flowing and spreading to an unintended region, and furthermore, the surface becomes smooth and the gloss form coating layers L31 to L34 can be formed by leaving the ink for a certain time in the temporary curing state. The coating layers L31 to L34 can be fixed by carrying out the full curing after the plane is smoothened.

Specifically, the controller 7 carries out the discharge of the clear ink and the irradiation of the ultraviolet ray of a low light amount by the ultraviolet ray irradiating device 4 or 5 on the back side in the advancing direction in one forward movement or backward movement of the carriage 2 to perform the temporary curing of the clear ink, repeats such discharge and irradiation over plural times, as necessary, to form the coating layers L31 to L34 of a predetermined thickness, and lastly, irradiates the ink with the ultraviolet ray irradiating device 4 and/or 5 and scans the same with the carriage 2 without discharging the clear ink to perform the full curing and fix the formed coating layers L31 to L34.

In the full curing, the controller 7 adjusts the intensity (illuminance) of the ultraviolet ray irradiating device 4 and/or 5 and the moving speed (scanning speed) of the carriage 2 so that the coating layers L31 to L34 are irradiated with the ultraviolet ray of a sufficient light amount. The clear ink discharged to form the coating layers L31 to L34 corresponds to a second ultraviolet curing type ink of the present disclosure.

As described above, the controller 7 controls the reciprocate movement of the carriage 2, the discharge of the clear ink by the ink jet heads 6*e*, 6*f*, and the irradiation of the ultraviolet ray by the ultraviolet ray irradiating devices 4, 5, and in particular, causes the ink jet heads 6*e*, 6*f* to selectively discharge the clear ink to an area where the projection main bodies L21 to L24 exist to form the coating layers L31 to L34, so that as shown in FIG. 3, each coating layer L31 to L34 is spaced apart from each other, and the projection main bodies L21 to L24 are evened by the coating layer thus reducing the drop of the bump and suppressing the reduction of the stereoscopic effect.

Furthermore, in the present embodiment, the temporary curing is carried out before the full curing when forming the coating layers L31 to L34, and thus the surface of the coating layers L31 to L34 is smoothened, and the ink can be suppressed from flowing and spreading from the landed position, in regards to which, the projection main bodies L21 to L24 are evened by the coating layer and the drop of the bump can be suppressed from reducing.

Each coating layer L31 to L34 does not necessarily need to be spaced apart from each other. In other words, even if the temporary curing is not carried out or the curing in the temporary curing is not sufficient and the clear ink to become the coating layer flows and spreads and connects to each other, the drop of the bump can be increased by selectively discharging the clear ink to an area corresponding to the projection main bodies L21 to L24 when forming the coating layer compared to when evenly coating the entire surface.

Furthermore, in the present embodiment, instead of directly forming the projection main bodies L21 to L24 on the acrylic medium M, the underlayer L11 is first formed on the medium M, and then the projection main bodies L21 to L24 are formed thereon so as to be spaced apart from each other and the coating layers L31 to L34 covering the projection main bodies are also formed, whereby the unintended spread of the landing dot of the clear ink discharged to form the projection main bodies L21 to L24 and the clear ink discharged to form the coating layers L31 to L34 can be suppressed.

Figure 4:
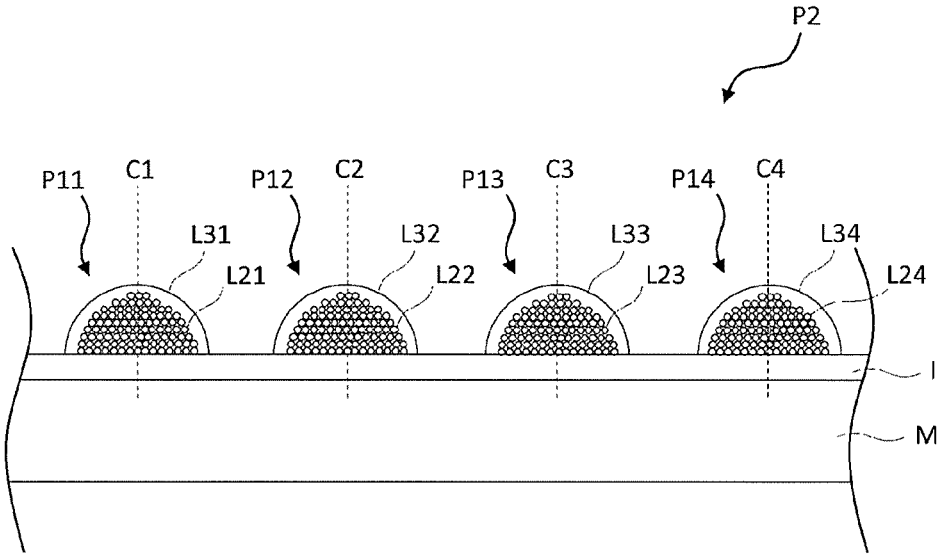
FIG. 4 is a view showing a cross-sectional view of a printed matter according to another example of the present embodiment.

FIG. 4 is a view showing a cross-sectional view of a printed matter according to another example of the present embodiment. In the example of FIG. 3, the projections P11 to P14 function as the microlens, but in a printed matter P2 of the present example, the projections P11 to P14 for providing change in texture or tactual sense are formed. As shown in FIG. 4, in the printed matter P2 of the present example, the image I is formed using the color ink on the medium M, a plurality of projection main bodies L21 to L24 are formed thereon using the clear ink, and the coating layers L31 to L34 are formed so as to cover the projection main bodies L21 to L24, whereby the projections P11 to P14 are formed on the image I in such manner.

(Formation of Projection Main Body)

The controller 7 forms the dome shaped projection main bodies L21 to L24 spaced apart from each other by printing the clear ink to the matted form on the image I. The controller 7 selectively discharges the clear ink to the periphery of the plurality of projection centers C1 to C4 spaced apart from each other from the ink jet heads 6*e*, 6*f* while reciprocating the carriage 2 to form a plurality of island-shaped projection main bodies L21 to L24. The controller 7 discharges the clear ink from the ink jet heads 6*e*, 6*f* in both the forward path and the backward path of the carriage 2, and turns ON the ultraviolet ray irradiating device 5 in the forward path and turns ON the ultraviolet ray irradiating device 4 in the backward path. The projection main bodies L21 to L24 are thereby formed to the matted form.

At the time of forming the projection main bodies L21 to L24, the controller 7 carries out the discharge of the clear ink to a circular region having the projection center C1 to C4 as the center by the ink jet heads 6*e*, 6*f* and the irradiation of the ultraviolet ray by the ultraviolet ray irradiating device 4 or 5 on the back side in the advancing direction in one forward movement or backward movement of the carriage 2, and repeats such discharge and irradiation over plural times, as necessary, to form the projection main bodies L21 to L24 having the projection centers C1 to C4 as the center. In this case, the controller 7 gradually reduces the diameter of the circular region to discharge the ink toward an upper layer according to the print data to form the dome shaped projection main bodies L21 to L24.

(Coating)

After the matted projection main bodies L21 to L24 are formed, the controller 7 reciprocates the carriage 2 and selectively discharges the clear ink from the ink jet heads 6*e*, 6*f* to a range of covering each of the projection main bodies L21 to L24 to form coating layers L31 to L34. The controller 7 again selectively discharges the clear ink to the circular region having the projection centers C1 to C4 as the center.

Furthermore, the controller 7 turns ON the ultraviolet ray irradiating device 4 or 5 on the back side in the advancing direction simultaneously with the discharge of the clear ink from the ink jet heads 6*e*, 6*f*, where the light amount is set to an amount the viscosity can be increased to an extent the landed clear ink is completely cured and the fluidity is not lost. The landed clear ink is thereby performed a temporary curing, and the clear ink discharged so as to cover the projection main bodies L21 to L24 can be suppressed from flowing and spreading to an unintended region, and furthermore, the surface becomes smooth and the gloss form coating layers L31 to L34 can be formed by leaving the ink for a certain time in the temporary curing state. The coating layers L31 to L34 can be fixed by carrying out the full curing after the surface is smoothened.

Specifically, the controller 7 carries out the discharge of the clear ink and the irradiation of the ultraviolet ray of a low light amount by the ultraviolet ray irradiating device 4 or 5 on the back side in the advancing direction in one forward movement or backward movement of the carriage 2 to perform the temporary curing of the clear ink, repeats such discharge and irradiation over plural times to form the coating layers L31 to L34 of a predetermined thickness, and lastly, irradiates the ink with the ultraviolet ray irradiating device 4 and/or 5 and scans the same with the carriage 2 without discharging the clear ink to fully cure and fix the formed coating layers L31 to L34.

In the full curing, the controller 7 adjusts the intensity (illuminance) of the ultraviolet ray irradiating device 4 and/or 5 and the moving speed (scanning speed) of the carriage 2 so that the coating layers L31 to L34 are irradiated with the ultraviolet ray of a sufficient light amount.

In the example described above, the projections P11 to P14 and the coating layers L31 to L34 are formed with the clear ink having translucency so as not to impair the visibility of the image I, but the following variants may also be adopted. In other words, the visibility of the image I can be ensured by forming the projection main bodies L21 to L24 with the color ink corresponding to the image I, and using the clear ink for the coating layers L31 to L34.

Alternatively, the projection main bodies L21 to L24 may be formed with an arbitrary ink, and the coating layers L31 to L34 may be formed with the color ink corresponding to the image I. In such a case, the boundary with the gloss form coating layers L31 to L34 is desirably suppressed from standing out by forming the image I to a gloss form. As described above, the present disclosure is not limited to forming the plurality of projections P11 to P14 with the clear ink. Furthermore, even when using the clear ink having translucency, such clear ink may be colorless and transparent or may be colored and transparent, and a transmittance thereof is also arbitrary. Furthermore, in the example of FIGS. 3 and 4, the projections P11 to P14 have a dome shape with a circular horizontal cross-section, but the shape of the projection is not limited thereto and may be an arbitrary shape.

Furthermore, in the example described above, as shown in FIGS. 3 and 4, the projection main bodies L21 to L24 are formed with nine layers of clear ink (total number of forward movement and backward movement in which discharge of clear ink and irradiation of ultraviolet ray are simultaneously carried out is nine times), but the number of layers of clear ink for forming the projection main body is not limited thereto, and may be, for example, one to ten layers.

As described above, the dot size (diameter) of the plurality of liquid droplets of the ink forming the projection main bodies L21 to L24 is also specified in the print data, but for example, three sizes (S size, M size, L size) may be prepared for the dot size, and one of the sizes may be selected, or the liquid droplet of a plurality of types of size may be used to form one projection main body L21 to L24. Here, for example, the S size may be set to 40 to 50 μm, the M size may be set to 50 to 70 μm, and the L size may be set to 80 to 100 μm.

The size (diameter) of the projection main body L21 to L24 may be, for example, about 1,000 μm (1 mm), and the height of the projection main bodies L21 to L24 may be about 70 μm to 120 μm if used as a lens, and about 100 μm to 400 μm if used as a projection that provides change in texture or tactual sense.

The coating layers L31 to L34 can be formed with one layer of ink droplet, but may be formed by a plurality of layers through plural forward movement and backward movement, as necessary, as described above.

As described above, the projection main bodies L21 to L24 may be formed with one layer of clear ink and the coating layers L31 to L34 may also be configured with one layer of clear ink. In such a case, the formation of the projection main body and the formation of the coating layer can be carried out by simply carrying out one sub-scanning in one direction on the medium M.

Figure 5:
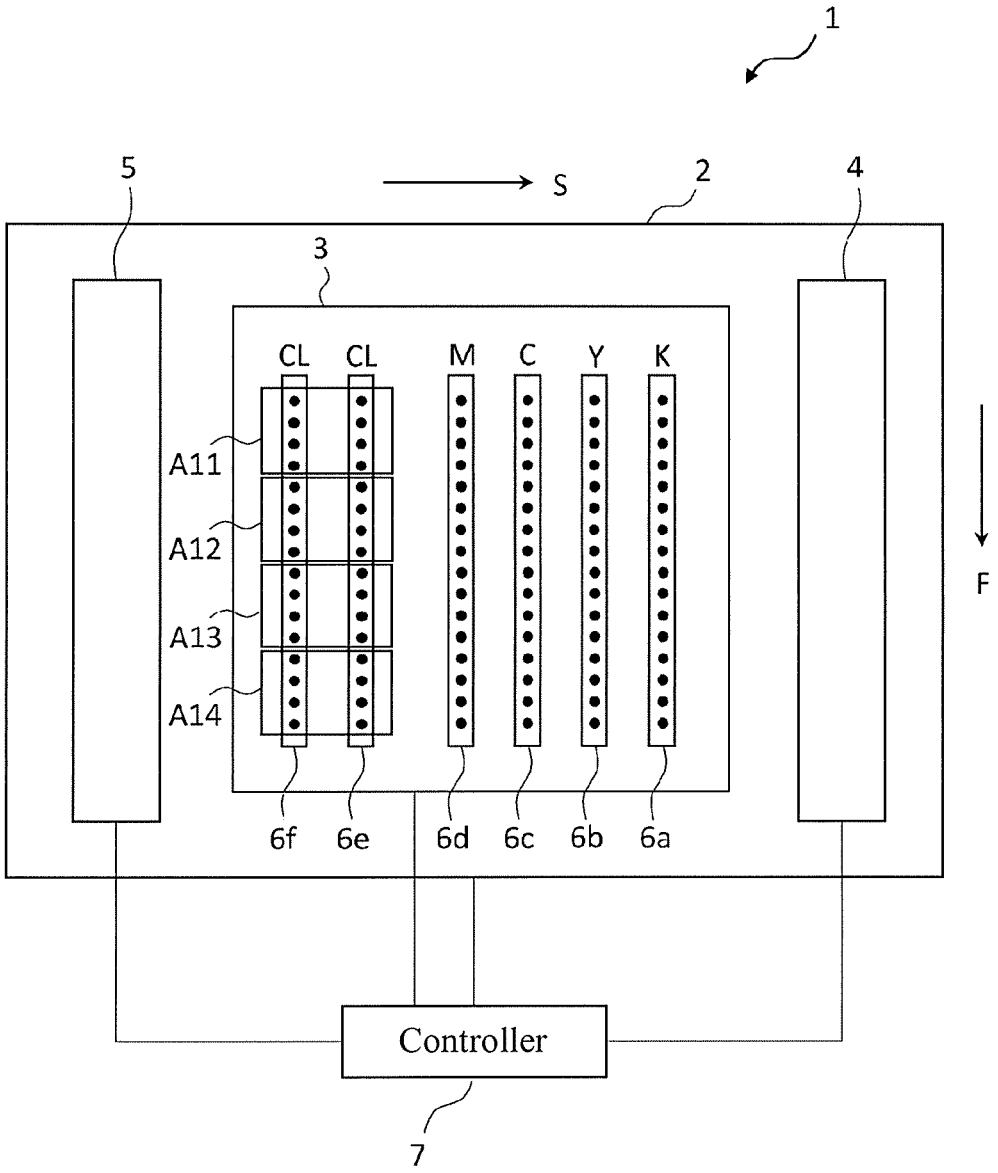
FIG. 5 is a view showing a configuration of an ink jet printer system including an ink jet printer according to another example of the present embodiment.
Figure 6:
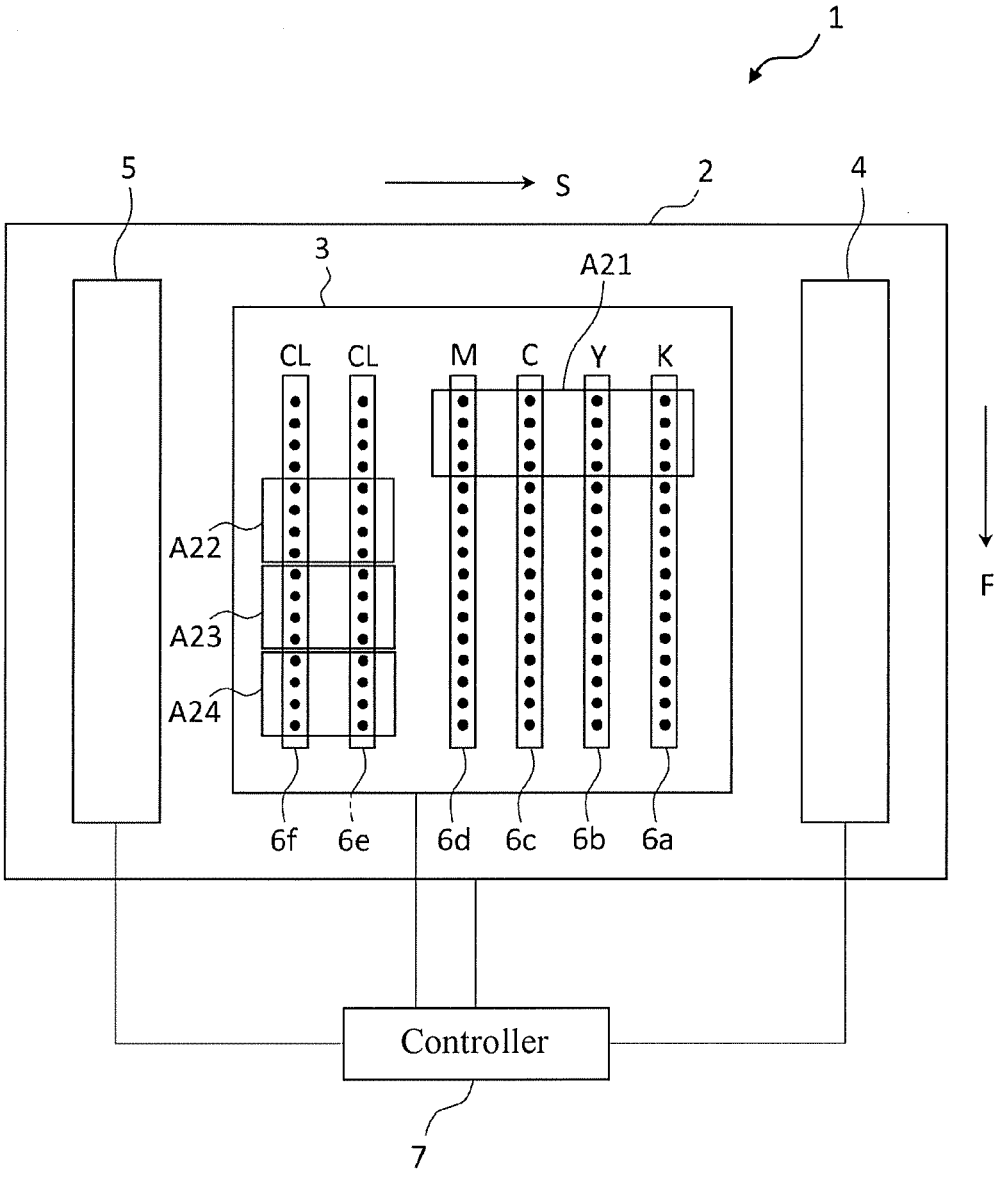
FIG. 6 is a view showing a configuration of an ink jet printer system including an ink jet printer according to another example of the present embodiment.
Figure 7:
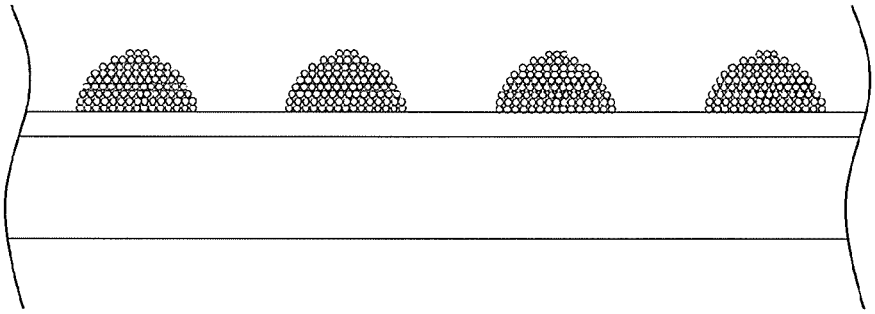
FIG. 7 (Related Art)
FIG. 7 is a view showing a conventional microlens.

FIGS. 5 and 6 are schematic views showing the ink jet printer for realizing the formation of the projection with one sub-scanning. FIG. 5 is a view showing a configuration of the ink jet printer of when forming the projections P11 to P14 on the surface on the side opposite the image forming surface of the printed matter as shown in FIG. 3, and FIG. 6 is a view showing a configuration of the ink jet printer of when forming the projections P11 to P14 on the image forming surface of the printed matter as shown in FIG. 4.

In the case of FIG. 5, among the nozzle rows formed in the ink jet head 6*e* and the ink jet head 6*f* that discharge the clear ink, the clear ink is discharged only from a nozzle row of a first nozzle region A11 arranged at a portion ¼ on the back side in the feed direction F, a nozzle row of a second nozzle region A12 arranged at a portion ¼ to ½ on the back side in the feed direction F, and a nozzle row of a third nozzle region A13 arranged at a portion of ½ to ¼ on the front side in the feed direction F, and the clear ink is not discharged from a nozzle row of a fourth nozzle region A14 arranged at a portion of ¼ on the front side in the feed direction F.

The medium M is transported by a length of ¼ of the ink jet head 6 in the feed direction F (i.e., path width of the feed direction F is ¼ of the length of the ink jet head 6) for every forward movement or backward movement in the scanning direction S. Thus, the clear ink discharged from the first nozzle region A11 of the ink jet head 6*e* and the ink jet head 6*f* is first applied to the medium M, the ultraviolet ray is irradiated from a portion corresponding to the first nozzle region A11 of the ultraviolet ray irradiating device on a back side in the advancing direction of the ultraviolet ray irradiating devices 4, 5, and the clear ink is immediately cured thus forming the underlayer L11.

Thereafter, the medium M is transported by the path width in the feed direction F, and then the clear ink discharged from the second region A12 of the ink jet head 6*e* and the ink jet head 6*f* is applied on the underlayer L11 thus forming the projection main bodies L21 to L24. The projection main bodies L21 to L24 are also irradiated with the ultraviolet ray from a portion corresponding to the second nozzle region A12 of the ultraviolet ray irradiating device on the back side in the advancing direction of the ultraviolet ray irradiating devices 4, 5, and the clear ink is immediately cured.

Thereafter, the medium M is transported by the path width in the feed direction F, and then the clear ink discharged from the third region A13 of the ink jet head 6*e* and the ink jet head 6*f* is applied on the projection main bodies L21 to L24 thus forming the coating layers L31 to L34. The coating layers L31 to L34 are also irradiated with the ultraviolet ray from a portion corresponding to the third nozzle region A13 of the ultraviolet ray irradiating device on the back side in the advancing direction of the ultraviolet ray irradiating devices 4, 5, but as the intensity of the ultraviolet ray of the relevant portion is set weak, the clear ink is not immediately fully cured and is temporarily cured.

Thereafter, the medium M is further transported by the path width in the feed direction F, and then irradiated with the ultraviolet ray from a portion corresponding to the fourth nozzle region A14 of the ultraviolet ray irradiating device 4 and/or 5, so that the coating layers L31 to L34 are completely cured (full curing).

According to the above configuration, the underlayer L11, the projection main bodies L21 to L24, and the coating layers L31 to L34 can be formed by simply feeding the medium M once in the feed direction F.

In the case of FIG. 6, among the nozzle rows formed in the ink jet head 6*a* to the ink jet head 6*d* that discharge the color ink, the color ink is discharged only from the nozzle row of the first nozzle region A21 arranged at a portion of ¼ on the back side in the feed direction F, and the color ink is not discharged from the nozzle row arranged at a portion of ¾ on the front side in the feed direction F.

Furthermore, among the nozzle rows formed in the ink jet head 6*e* and the ink jet head 6*f* that discharge the clear ink, the clear ink is discharged only from a nozzle row of a second nozzle region A22 arranged at a portion of ¼ to ½ on the back side in the feed direction F, and a nozzle row of a third nozzle region A23 arranged at a portion of ½ to ¼ on the front side in the feed direction F, and the clear ink is not discharged from a nozzle row of a fourth nozzle region A24 arranged at a portion of ¼ on the front side and the back side in the feed direction F.

The medium M is transported by a length of ¼ of the ink jet head 6 in the feed direction F (i.e., path width of the feed direction F is ¼ of the length of the ink jet head 6) for every forward movement or backward movement in the scanning direction S. Thus, the color ink discharged from the first nozzle region A21 of the ink jet head 6*a* to the ink jet head 6*d* is first applied to the medium M, and irradiated with the ultraviolet ray from a portion corresponding to the first nozzle region A21 of the ultraviolet ray irradiating device on the back side in the advancing direction of the ultraviolet ray irradiating devices 4, 5 so that the clear ink is immediately cured.

Thereafter, the medium M is transported by the path width in the feed direction F, and then the clear ink discharged from the second region A22 of the ink jet head 6*e* and the ink jet head 6*f* is applied on the surface (upper layer) of the color ink, thus forming the projection main bodies L21 to L24. The projection main bodies L21 to L24 are also irradiated with the ultraviolet ray from a portion corresponding to the second nozzle region A22 of the ultraviolet ray irradiating device on the back side in the advancing direction of the ultraviolet ray irradiating devices 4, 5 so that the clear ink is immediately cured.

Thereafter, the medium M is transported by the path width in the feed direction F, and then the clear ink discharged from the third region A23 of the ink jet head 6*e* and the ink jet head 6*f* is applied on the projection main bodies L21 to L24, thus forming the coating layers L31 to L34. The coating layers L31 to L34 are also irradiated with the ultraviolet ray from a portion corresponding to the third nozzle region A23 of the ultraviolet ray irradiating device on the back side in the advancing direction of the ultraviolet ray irradiating devices 4, 5, but the clear ink is not immediately fully cured and is temporarily cured as the intensity of the ultraviolet ray of the relevant portion is set weak.

Thereafter, the medium M is further transported by the path width in the feed direction F, and then irradiated with the ultraviolet ray from a portion corresponding to the fourth nozzle region A24 of the ultraviolet ray irradiating device 4 and/or 5 so that the coating layers L31 to L34 are completely cured (full curing).

According to the above configuration, the image I, the projection main bodies L21 to L24, and the coating layers L31 to L34 can be formed by simply feeding the medium M once in the feed direction F.

In the cases of FIGS. 5 and 6, two rows of ink jet heads that discharge the clear ink are prepared (ink jet heads 6*e*, 6*f*), so that the projection main bodies L21 to L24 and the coating layers L31 to L34 can be formed with a maximum of two layers.

Hereinafter, effects of the printing device and the printing method of the present embodiment will be described. (1) The ink jet printer 1 includes the head unit 3 mounted with the ink jet head 6 that discharges the ultraviolet curing type ink as a liquid droplet; ultraviolet ray irradiating devices 4, 5 that irradiate the medium M discharged with the ultraviolet curing type ink with the ultraviolet ray, the carriage 2 that relatively reciprocates the ink jet head 6 and the ultraviolet ray irradiating devices 4, 5 in the scanning direction S with respect to the medium M, and the controller 7 that controls the drive of the ink jet head 6, the ultraviolet ray irradiating devices 4, 5 and the carriage 2. The controller 7 carries out the selective discharge of the first ultraviolet curing type ink to a plurality of landing positions by the ink jet head 6 and the irradiation of the first ultraviolet curing type ink with the ultraviolet ray by the ultraviolet ray irradiating devices 4, 5 (repeated as necessary) while reciprocating the carriage 2 to form the projection main bodies L21 to L24 of the first ultraviolet curing type ink at the plurality of landing positions, and causes the ink jet head 6 to selectively discharge a second ultraviolet curing type ink so as to land on the plurality of projection main bodies L21 to L24 and causes the ultraviolet ray irradiating devices 4, 5 to irradiate the second ultraviolet curing type ink with the ultraviolet ray so as to cure the second ultraviolet curing type ink to the gloss form.

According to such configuration, the projection main bodies L21 to L24 are formed with the first ultraviolet curing type ink, and the second ultraviolet curing type ink of gloss form is coated thereon, so that the projections P11 to P14 having a smooth surface can be formed. Furthermore, since the second ultraviolet curing type ink is selectively discharged so as to land on the projection main bodies L21 to L24 formed by the first ultraviolet curing type ink, each projection P11 to P14 can have a stereoscopic effect compared to when the second ultraviolet curing type ink is applied over the entire surface.

(2) In the ink jet printer 1, the controller 7 causes the ink jet head 6 to selectively discharge the first ultraviolet curing type ink to a plurality of landing positions and the ultraviolet ray irradiating devices 4, 5 to irradiate the first ultraviolet curing type ink with the ultraviolet ray in one forward movement or backward movement by the carriage 2, and repeats the discharge of the first ultraviolet curing type ink and the irradiation of the first ultraviolet curing type ink with the ultraviolet ray to form the projection main bodies L21 to L24 of matted form of the first ultraviolet curing type ink at the plurality of landing positions.

According to such configuration, the projection main bodies L21 to L24 by the first ultraviolet curing type ink are formed by a plurality of layers of first ultraviolet curing type ink by repeating the discharge and the curing for every layer, and thus the size and the interval thereof can be arbitrarily set.

(3) In the ink jet printer 1, the controller 7 causes the ink jet head 6 to selectively discharge the second ultraviolet curing type ink so as to land on the plurality of projection main bodies L21 to L24, and the ultraviolet ray irradiating devices 4, 5 to irradiate the second ultraviolet curing type ink with the ultraviolet ray to perform the temporary curing of the second ultraviolet curing type ink (repeat discharge and temporary curing of second ultraviolet curing type ink, as necessary), and thereafter, causes the ultraviolet ray irradiating device 4, 5 to irradiate the second ultraviolet curing type ink with the ultraviolet ray to perform the full curing of the second ultraviolet curing type ink.

According to such configuration, the second ultraviolet curing type ink selectively discharged so as to land on the plurality of projection main bodies L21 to L24 can be cured to the gloss form by the full curing after the surface is smoothened while being suppressed from flowing and spreading to the periphery of the original landing position by the temporary curing.

(4) In the ink jet printer 1, the controller 7 may carry out the control so that the second ultraviolet curing type ink selectively discharged so as to land on the plurality of projection main bodies L21 to L24 is cured while being spaced apart from each other. According to such configuration, a more three-dimensional projections P11 to P14 having a smooth surface can be formed.

(5) In the ink jet printer 1, the ink jet head 6 may discharge the first ultraviolet curing type ink and the second ultraviolet curing type ink on a back surface of the surface formed with the image I in the transparent medium M, and the first ultraviolet curing type ink and the second ultraviolet curing type ink may be a clear ink. According to such configuration, the pluralities of projections P11 to P14 function as the microlens and provide change in the visual effect of the image M.

(6) In the ink jet printer 1, the ink jet head 6 may discharge the first ultraviolet curing type ink and the second ultraviolet curing type ink on the surface formed with the image I in the medium M, and the first ultraviolet curing type ink and the second ultraviolet curing type ink may be a clear ink. According to such configuration, the projection that does not impair the visibility of the image formed on the medium M can be formed on the image.

(7) In the ink jet printer 1, the ink jet head 6 may discharge the first ultraviolet curing type ink and the second ultraviolet curing type ink on the surface formed with the image in the medium M, and the second ultraviolet curing type ink may be a color ink corresponding to the image I. According to such configuration, the surface of the projections P11 to P14 can be formed and one part of the image can be formed with the second ultraviolet curing type ink.

(8) In the ink jet printer 1, the ink jet head 6 may discharge the first ultraviolet curing type ink and the second ultraviolet curing type ink on the surface formed with the image I in the medium M, and the first ultraviolet curing type ink may be a color ink corresponding to the image I and the second ultraviolet curing type ink may be a clear ink. According to such configuration, the projection main bodies L21 to L24 can be formed and one part of the image I can be formed with the first ultraviolet curing type ink. Furthermore, since the second ultraviolet curing type ink on the outer side of the projection main bodies L21 to L24 is the clear ink, the visibility of the image I formed in such manner is not impaired.

(9) In the ink jet printer 1, the carriage 2 may relatively move the ink jet head 6, the ultraviolet ray irradiating devices 4, 5, and the medium M in the feed direction F, and the controller 7 may form the projection main bodies L21 to L24 and configure the coating layers L31 to L34 of gloss form thereon by simply relatively moving the ink jet head 6, the ultraviolet ray irradiating devices 4, 5 and the medium M once in the feed direction F. According to such configuration, the projections P11 to P14 having a smooth surface can be formed at high speed.

(10) In the ink jet printer 1, each of the projection main bodies L21 to L24 may be configured by a plurality of liquid droplets of the first ultraviolet curing type ink. According to such configuration, the projections P11 to P14 of an arbitrary size can be formed.

(11) In the ink jet printer 1, each of the projection main bodies L21 to L24 may be configured by a plurality of layers of first ultraviolet curing type ink. According to such configuration, the projections P11 to P14 of an arbitrary height can be formed.

(12) In the ink jet printer 1, the height of the projection main bodies L21 to L24 may be 70 μm to 400 μm. According to such configuration, the projections P11 to P14 that function as the microlens or function as the projections that provide texture or tactual sense can be formed.

(13) A printing method of the embodiment of the present disclosure carries out selective discharge of the first ultraviolet curing type ink on a plurality of landing positions by the ink jet head 6 and the irradiation of the ultraviolet curing type ink with the ultraviolet ray by the ultraviolet ray irradiating device 4, 5 by relatively reciprocating the ink jet head 6 that discharges the ultraviolet curing type ink as the liquid droplet and the ultraviolet ray irradiating devices 4, 5 that irradiate the medium M discharged with the ultraviolet curing type ink with the ultraviolet ray with respect to the medium M (repeated as necessary) to form the projection main bodies L21 to L24 of the first ultraviolet curing type ink on the plurality of landing positions, and selectively discharges the second ultraviolet curing type ink from the ink jet head 6 so as to land on the plurality of projection main bodies L21 to L24 and irradiates the second ultraviolet curing type ink with the ultraviolet ray from the ultraviolet ray irradiating devices 4, 5 to cure the second ultraviolet curing type ink to the gloss form.

According to such configuration, the projection main bodies L21 to L24 are formed with the first ultraviolet curing type ink, and the second ultraviolet curing type ink of gloss form is coated thereon, so that the projections P11 to P14 having a smooth surface can be formed. Furthermore, since the second ultraviolet curing type ink is selectively discharged so as to land on the projection main bodies L21 to L24 formed by the first ultraviolet curing type ink, each projection P11 to P14 can have a stereoscopic effect compared to when the second ultraviolet curing type ink is applied over the entire surface.

INDUSTRIAL APPLICABILITY

The present disclosure has an effect of being able to form a projection with a smooth surface on the medium, and is useful as a printing device, and the like that discharges the ink to the medium through the ink jet method.

What is claimed is:

1. A printing device comprising:

an ink discharging unit that discharges an ultraviolet curing type ink as a liquid droplet;

an ultraviolet ray irradiating unit that irradiates a medium, to which the ultraviolet curing type ink is discharged, with an ultraviolet ray;

a scanning unit that relatively reciprocates the ink discharging unit, the ultraviolet ray irradiating unit, and the medium in a main scanning direction; and a controller that controls the ink discharging unit, the ultraviolet ray irradiating unit, and the scanning unit, wherein the controller carries out a selective discharge of a first ultraviolet curing type ink to a plurality of landing positions by the ink discharging unit and an irradiation of the first ultraviolet ray curing type ink with the ultraviolet ray by the ultraviolet ray irradiating unit while reciprocating the scanning unit to form a plurality of projection main bodies of the first ultraviolet ray curing type ink at the plurality of landing positions, causes the ink discharging unit to selectively discharge a second ultraviolet curing type ink so as to land on the plurality of projection main bodies, and causes the ultraviolet ray irradiating unit to irradiate the second ultraviolet curing type ink with the ultraviolet ray to cure the second ultraviolet ray curing type ink to a gloss form, wherein the controller causes the ink discharging unit to selectively discharge the first ultraviolet curing type ink to the plurality of landing positions and the ultraviolet ray irradiating unit to irradiate the first ultraviolet curing type ink with the ultraviolet ray immediately after the first ultraviolet curing type ink lands at predetermined positions, in one forward movement or one backward movement by the scanning unit, and repeats the selective discharge of the first ultraviolet curing type ink and the irradiation of the first ultraviolet curing type ink with the ultraviolet ray to form a plurality of matted projection main bodies of the first ultraviolet curing type ink at the plurality of landing positions, wherein the controller causes the ink discharging unit to selectively discharge a second ultraviolet curing type ink so as to land on the plurality of projection main bodies, and the ultraviolet ray irradiating unit to irradiate the second ultraviolet curing type ink with the ultraviolet ray, where a light amount of ultraviolet light is such that a viscosity of the second ultraviolet curing type ink increases to an extent that a fluidity is not lost, to perform a temporary curing of the second ultraviolet curing type ink, and thereafter causes the ultraviolet ray irradiating unit to irradiate the second ultraviolet curing type ink with the ultraviolet ray to perform a full curing of the second ultraviolet curing type ink.

2. The printing device according to claim 1, wherein the controller carries out a control so that the second ultraviolet curing type ink selectively discharged to land on the plurality of projection main bodies is cured while being spaced apart from each other.

3. The printing device according to claim 1, wherein the ink discharging unit discharges the first ultraviolet curing type ink and the second ultraviolet curing type ink onto a back surface of a surface formed with an image in a transparent medium, and the first ultraviolet curing type ink, and the second ultraviolet curing type ink are clear ink.

4. The printing device according to claim 1, wherein the ink discharging unit discharges the first ultraviolet curing type ink and the second ultraviolet curing type ink onto a surface formed with an image in the medium, and the first ultraviolet curing type ink and the second ultraviolet curing type ink are clear ink.

5. The printing device according to claim 1, wherein the ink discharging unit discharges the first ultraviolet curing type ink and the second ultraviolet curing type ink onto a surface formed with an image in the medium, and the second ultraviolet curing type ink is a color ink corresponding to the image.

6. The printing device according to claim 1, wherein the ink discharging unit discharges the first ultraviolet curing type ink and the second ultraviolet curing type ink onto a surface formed with an image in the medium, the first ultraviolet curing type ink is a color ink corresponding to the image and the second ultraviolet curing type ink is a clear ink.

7. The printing device according to claim 1, wherein the scanning unit relatively moves the ink discharging unit, the ultraviolet ray irradiating unit, and the medium in a sub-scanning direction orthogonal to the main scanning direction, the controller forms the plurality of projection main bodies and discharges the second ultraviolet curing type ink thereon and cures the ink to a gloss form by merely relatively moving the ink discharging unit, the ultraviolet ray irradiating unit, and the medium once in the sub-scanning direction.

8. The printing device according to claim 1, wherein each projection main body is configured by a plurality of liquid droplets of the first ultraviolet curing type ink.

9. The printing device according to claim 1, wherein a height of each projection main body is 70 μm to 400 μm.

10. The printing device according to claim 1, wherein the controller controls the temporary curing to be repeated through a discharge of the second ultraviolet curing type ink and an ultraviolet irradiation with the ultraviolet ray irradiating unit over a predetermined number of times.

11. The printing device according to claim 8, wherein each projection main body is configured by a plurality of layers of the first ultraviolet curing type ink.

12. A printing method comprising the steps of:

carrying out a selective discharge of a first ultraviolet curing type ink to a plurality of landing positions by an ink discharging unit and an irradiation of the first ultraviolet ray curing type ink with an ultraviolet ray by an ultraviolet ray irradiating unit while relatively reciprocating the ink discharging unit that discharges an ultraviolet curing type ink as a liquid droplet, the ultraviolet ray irradiating unit that irradiates a medium, to which the ultraviolet curing type ink is discharged, with an ultraviolet ray, and the medium to form a plurality of projection main bodies which are protruded from the medium;

by reciprocating the ink discharging unit, the ink discharging unit selectively discharging the first ultraviolet curing type ink to the plurality of landing positions and the ultraviolet ray irradiating unit irradiating the first ultraviolet curing type ink with the ultraviolet ray immediately after the first ultraviolet curing type ink lands at predetermined positions, in one forward movement or one backward movement by the scanning unit, and repeating the selective discharge of the first ultraviolet curing type ink and the irradiation of the first ultraviolet curing type ink with the ultraviolet ray to form a plurality of matted projection main bodies of the first ultraviolet curing type ink at the plurality of landing positions;

selectively discharging a second ultraviolet curing type ink from the ink discharging unit so as to land on the plurality of projection main bodies, and the ultraviolet ray irradiating unit irradiating the second ultraviolet curing type ink with the ultraviolet ray, where a light amount of ultraviolet light is such that a viscosity of the second ultraviolet curing type ink increases to an extent that a fluidity is not lost, to perform a temporary curing of the second ultraviolet curing type ink, and thereafter by using the ultraviolet ray irradiating unit, irradiating the second ultraviolet curing type ink to perform a full curing with the ultraviolet ray from the ultraviolet ray irradiating unit to cure the second ultraviolet curing type ink to a gloss form.

13. The printing method according to claim 12, wherein the temporary curing is controlled to be repeated through a discharge of the second ultraviolet curing type ink and an ultraviolet irradiation with the ultraviolet ray irradiating unit over a predetermined number of times.

* * * * *